US009273444B2

(12) United States Patent
Walling

(10) Patent No.: US 9,273,444 B2
(45) Date of Patent: Mar. 1, 2016

(54) VARIABLE RETAINING WALL SYSTEM

(71) Applicant: Nelson Kenneth Walling, Lower Gwynedd, PA (US)

(72) Inventor: Nelson Kenneth Walling, Lower Gwynedd, PA (US)

( * ) Notice: Subject to any disclaimer, the term of this patent is extended or adjusted under 35 U.S.C. 154(b) by 19 days.

(21) Appl. No.: 14/197,035

(22) Filed: Mar. 4, 2014

(65) Prior Publication Data

US 2014/0248094 A1 Sep. 4, 2014

Related U.S. Application Data

(60) Provisional application No. 61/772,313, filed on Mar. 4, 2013.

(51) Int. Cl.

| | |
|---|---|
| ***E02D 29/02*** | (2006.01) |
| ***E04C 1/39*** | (2006.01) |
| ***E04C 1/00*** | (2006.01) |

(52) U.S. Cl.

CPC ..... *E02D 29/025* (2013.01); *E02D 29/02* (2013.01); *E04C 1/00* (2013.01); *E04C 1/39* (2013.01); *E02D 2600/20* (2013.01)

(58) Field of Classification Search

CPC ..... E02D 29/0266; E02D 2250/0007; E02D 2300/002; E02D 2600/20; E02D 29/025; E04C 1/00; E04C 1/39; E04B 2002/0215; E04B 2002/0245; E04B 2002/0263; E04B 2002/0256; B28B 17/0027

See application file for complete search history.

(56) References Cited

U.S. PATENT DOCUMENTS

| | | | | |
|---|---|---|---|---|
| 5,711,129 | A | 1/1998 | Woolford | |
| 5,951,210 | A * | 9/1999 | Maguire et al. | 405/286 |
| 7,448,830 | B2 * | 11/2008 | MacDonald et al. | 405/284 |
| 7,618,892 | B2 * | 11/2009 | Morikazu | 438/667 |
| 7,963,727 | B1 * | 6/2011 | Wauhop | 405/286 |
| 8,381,478 | B2 | 2/2013 | Leach et al. | |
| 2002/0001509 | A1 | 1/2002 | Hong | |
| 2002/0187010 | A1 * | 12/2002 | MacDonald et al. | 405/284 |
| 2007/0196184 | A1 * | 8/2007 | Hammer et al. | 405/284 |
| 2012/0233952 | A1 * | 9/2012 | Hammer | 52/588.1 |

* cited by examiner

*Primary Examiner* — John Kreck
*Assistant Examiner* — Carib Oquendo

(57) ABSTRACT

A variable retaining wall system may include a block having a top, a bottom, and a hollow core area. At least one set of setback knobs may attach to the block. The at least one set of setback knobs may include a primary set of setback knobs and a secondary set of setback knobs of a different angle than the primary set of setback knobs. The at least one set of setback knobs may be removable.

11 Claims, 3 Drawing Sheets

VARIABLE RETAINING WALL SYSTEM

CROSS-REFERENCE TO RELATED APPLICATION

This application claims the benefit of U.S. provisional application No. 61/772,313, filed Mar. 4, 2013, the contents of which are herein incorporated by reference.

BACKGROUND OF THE INVENTION

The present invention relates to retaining walls and, more particularly, to a variable retaining wall system.

When using a knob to provide the correct set back of a retaining wall, a different setback degree requires a different stone, requiring additional product inventory for the manufacturer, distributor, and installer. Retailers of retaining wall products have limited space and capital for additional inventory. Customers sometimes change their minds, or local soils might require a different wall setback requiring a different product. There are times when walls need to have a smaller degree of setback and times when a larger degree is needed, depending on the space and height of the wall. The only choice at present is to have additional inventory for both degrees of setback, or have a double faced stone. When a knob or protrusion needs to be removed, it normally breaks above the surface and affects height, or it requires additional labor. The package for retaining walls requires additional labor and equipment. The cost of machinery, labor, and cribbing is a burden on all parties to make the package safe when retaining walls with knobs are packaged. The additional inventory and absence of options place a burden on the retailer and the end user. Retaining walls have a height specification that requires the height never vary more than ⅛ inch. When multiple walls are stacked on each other, variance can multiply, requiring the installer to spend time cleaning the protrusion to a point below the surface.

Currently, single-faced devices have only one choice for a setback degree. These devices require, while packaging, a machine to turn the stones over to interlock the knobs into the cores of the stones below, or they must add shimming support manually to keep the package flat. These devices require the removal of a protrusion that leaves a slight residue that must be ground down.

Current solutions require a special mold that allows insertion of a bottom groove in the stone, but requires the use of a stone with double faces. This is more costly to produce, and serves no purpose because retaining walls are only single sided and one side will face the retained soil.

As can be seen, there is a need for a variable retaining wall system that allows for multiple set backs from the same single-sided stone.

SUMMARY OF THE INVENTION

In one aspect of the present invention, a variable retaining wall system comprises: a block having a top, a bottom, and a hollow core area; and at least one set of setback knobs attached to the block.

In another aspect of the present invention, a method for creating multiple setback positions for a retaining wall comprises: placing a first variable retaining wall system upside down on top of a second variable retaining wall system, wherein the variable retaining wall system is defined as a block having a top, a bottom, a hollow core area, a primary set of setback knobs attached to a set of break off recesses, wherein the primary set of setback knobs are attached to the block, and a secondary set of setback knobs having a different angle than the primary set of setback knobs, wherein the secondary set of setback knobs attaches to the top of the block; positioning the primary set of setback knobs of the first variable retaining wall system to rest against the a front of the core area of the second variable retaining wall system; removing the primary set of setback knobs with a tool; and laying the first variable retaining wall system down so that the secondary set of setback knobs are aligned with the front of the core area of the second variable retaining wall system.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides a variable retaining wall system that may include a block having a top, a bottom, and a hollow core area. At least one set of setback knobs may attach to the top of the block. The at least one set of setback knobs may include a primary set of setback knobs and a secondary set of setback knobs of a different angle than the primary set of setback knobs. The at least one set of setback knobs may be removable.

The present invention may eliminate the need for multiple inventories of stones with knobs that have different setbacks. The present invention may provide multiple setbacks from a single face on the same stone. The stone may be a block. A recess around a break off of knobs may insure that the break may happen below a top surface of the stone. Packing may be less costly, and there may be a reduction of cribbing on jobsites due to using the knob support angles to allow the stones to be supported without additional packaging equipment and without adding additional cribbing material.

Figure 1:
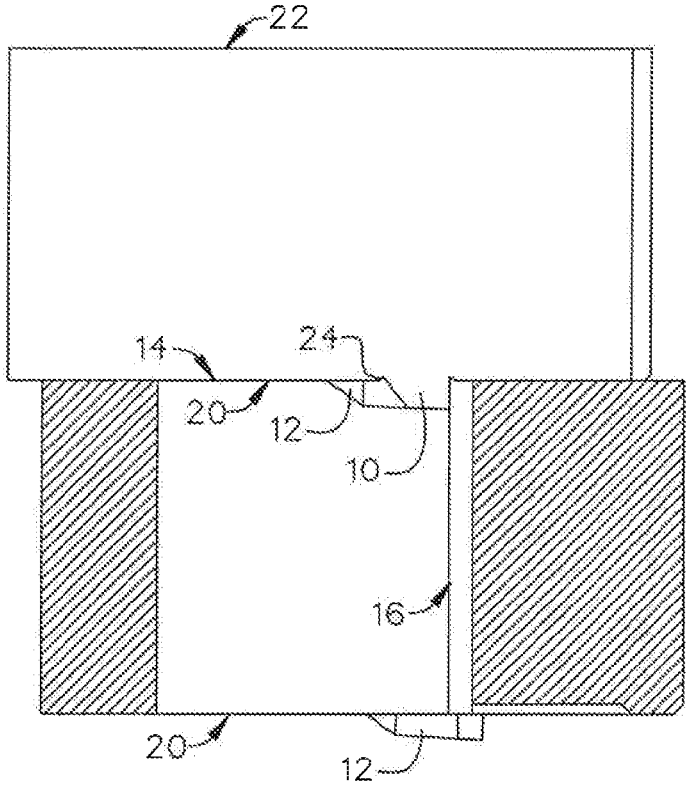
FIG. 1 is a section view of an exemplary embodiment of the present invention demonstrated with a primary set of setback knobs.
Figure 2:
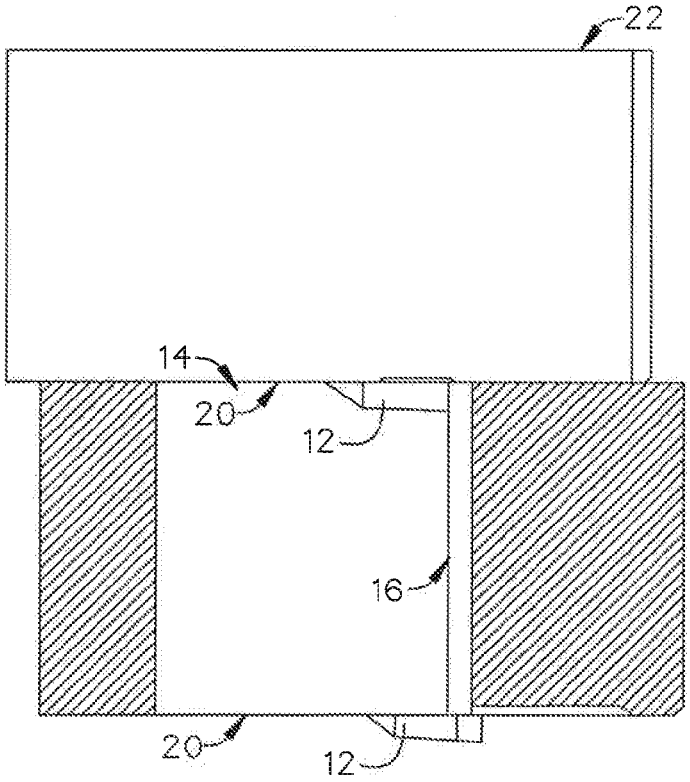
FIG. 2 is a section view of an exemplary embodiment of the present invention demonstrated without the primary set of setback knobs.
Figure 3:
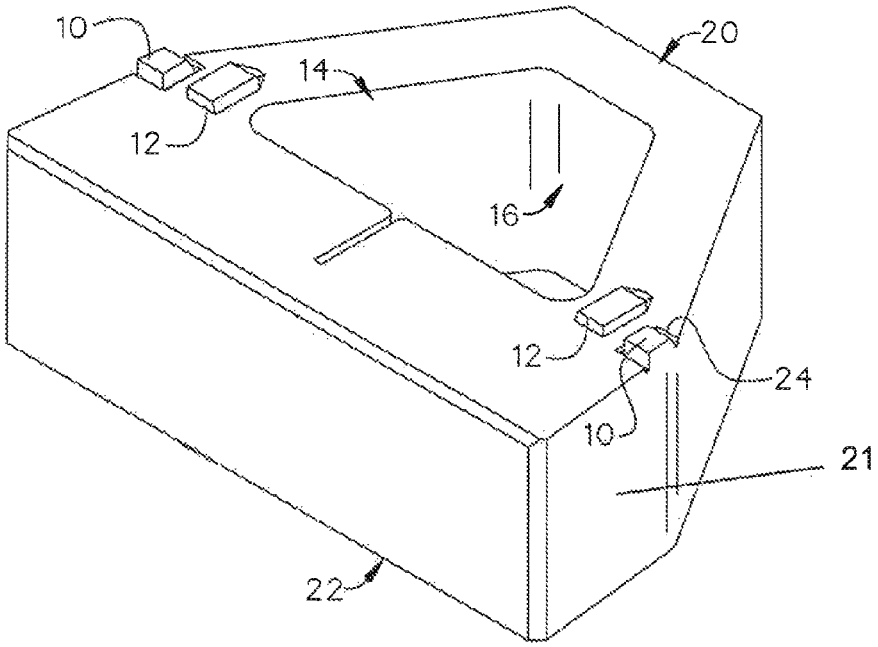
FIG. 3 is a perspective view of an exemplary embodiment of the present invention.

As is illustrated in FIGS. 1 through 5, the present invention may include a block 21 having a top 20, a bottom 22 and a hollow core area 14. The block 21 may be placed above another block 21 in series as shown in FIGS. 1 and 2. Along the top 20 of the block 21 may be at least one set of setback knobs. In certain embodiments, the at least one set of setback knobs may have a break off recess 24 below the level of the top 20 of the block 21. In certain embodiments, the at least one set of setback knobs may include a primary set of setback knobs 10 and a secondary set of setback knobs 12. In certain embodiments, the primary set of setback knobs 10 and the secondary set of setback knobs 12 may be positioned along a front 16 of the core area 14.

The variable retaining wall system may be manufactured with multiple setback knobs. In certain embodiments, the system may be made in a mold, using a dry-cast concrete products production machine. The primary set of setback knobs 10 may establish one setback degree. When another setback may be required, the primary set of setback knobs 10 may be broken off of the block 21 and the secondary set of setback knobs 12 may provide an alternate degree of setback. The system may be stabilized by a set degree for support of the block 21 above using the top of the at least one set of setback knobs. The at least one set of setback knobs may have the break off recess 24 designed to, if the knob is broken, separate below the surface of the top 20 of the block 21.

Figure 4:
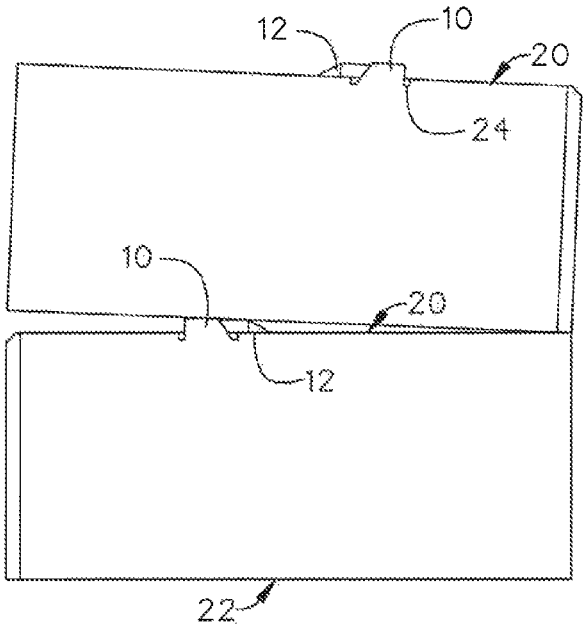
FIG. 4 is a side view of an exemplary embodiment of the present invention demonstrating angular placement.
Figure 5:
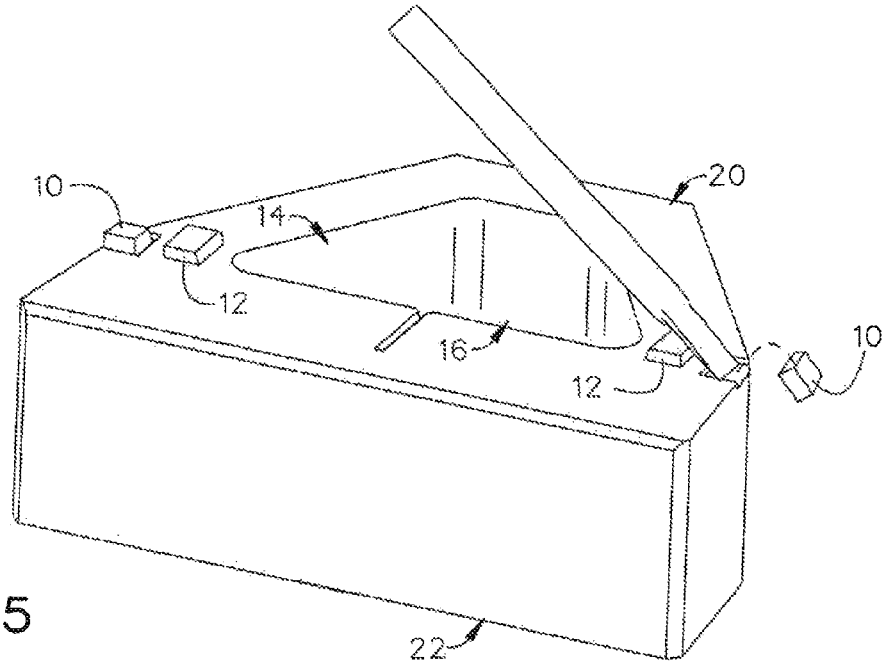
FIG. 5 is a perspective view of an exemplary embodiment of the present invention demonstrating removal of the primary set of setback knobs.

A method of using the variable retaining wall system may include the following. A builder of a retaining wall may like to build with a batter determined by the primary setback; the builder may place the system upside down so that the primary set of setback knobs 10 rest against the front 16 of the core area 14. When the builder wants the batter determined by the secondary setback, the builder may remove the primary set of setback knobs 10 with a tool such as a chisel or the like, and lay the system so that the secondary set of setback knobs 12 may be aligned with the front 16 of the core area 14. Using the secondary set of setback knobs 12 may allow the system to provide an additional angle to the top 20 of the block 21 as is shown in FIG. 4 in order to correct for any adjustments that may be required. The secondary set of setback knobs 12 may also be used in the transportation of the system to protect the components by providing an angled set when a block 21 is placed over another block 21 while in transport.

In certain embodiments, the block may be made from a cast concrete, plastic, clay or the like. In certain embodiments, the variable retaining wall system may be used to produce a retaining wall, other decorative landscape, garden wall and the like.

It should be understood, of course, that the foregoing relates to exemplary embodiments of the invention and that modifications may be made without departing from the spirit and scope of the invention as set forth in the following claims.

What is claimed is:

1. A variable retaining wall system comprising:

a block having a top, a bottom, and a hollow core area; at least one set of setback knobs attached to the block; and a set of break off recesses below a level of the top of the block, wherein the at least one set of setback knobs attaches to the set of break off recesses.

2. The variable retaining wall system of claim 1, wherein the block is made from a cast concrete.

3. The variable retaining wall system of claim 1, wherein the at least one set of setback knobs attach to the block along a front of the hollow core area.

4. The variable retaining wall system of claim 1, wherein the at least one set of setback knobs comprises a primary set of setback knobs removably attached to the set of break off recesses below the level of the top of the block.

5. The variable retaining wall system of claim 4, wherein the at least one set of setback knobs further comprises a secondary set of setback knobs having a different angle than the primary set of setback knobs.

6. A method for creating multiple setback positions for a retaining wall comprising:

placing a first variable retaining wall system upside down on top of a second variable retaining wall system, wherein the variable retaining wall system is defined as a block having a top, a bottom, a hollow core area, a primary set of setback knobs attached to a set of break off recesses on the block below a level of the top of the block, and a secondary set of setback knobs having a different angle than the primary set of setback knobs, wherein the secondary set of setback knobs attaches to the top of the block;

positioning the primary set of setback knobs of the first variable retaining wall system to rest against a front of the hollow core area of the second variable retaining wall system;

removing the primary set of setback knobs with a tool; and laying the first variable retaining wall system down so that the secondary set of setback knobs are aligned with the front of the hollow core area of the second variable retaining wall system.

7. The method of claim 6, wherein the block is made from a cast concrete.

8. A variable retaining wall system comprising:

a block having a top, a bottom, and a hollow core area; and at least one set of setback knobs attached to the block, wherein the at least one set of setback knobs comprises a primary set of setback knobs removably attached to a set of break off recesses below a level of the top of the block.

9. The variable retaining wall system of claim 8, wherein the at least one set of setback knobs further comprises a secondary set of setback knobs having a different angle than the primary set of setback knobs.

10. The variable retaining wall system of claim 8, wherein the block is made from a cast concrete.

11. The variable retaining wall system of claim 8, wherein the at least one set of setback knobs attach to the block along a front of the hollow core area.

* * * * *